US005332951A

United States Patent [19]

Turner et al.

[11] Patent Number: 5,332,951

[45] Date of Patent: Jul. 26, 1994

[54] CIRCUIT FOR DRIVING GAS DISCHARGE LAMPS HAVING PROTECTION AGAINST DIODE OPERATION OF THE LAMPS

[75] Inventors: Thomas W. Turner, Hanover Park; Mihail S. Moisin, Lake Forest, both of Ill.

[73] Assignee: Motorola Lighting, Inc., Buffalo Grove, Ill.

[21] Appl. No.: 968,885

[22] Filed: Oct. 30, 1992

[51] Int. Cl.[5] ..... H05B 37/02

[52] U.S. Cl. ..... 315/209 R; 315/219; 315/220; 315/221

[58] Field of Search ..... 315/209 R, 219, DIG. 7, 315/220, 221

[56] References Cited

U.S. PATENT DOCUMENTS

| | | | |
|---|---|---|---|
| 5,124,619 | 6/1992 | Moisin et al. | 315/219 |
| 5,130,610 | 7/1992 | Kakitani | 315/219 |
| 5,138,236 | 8/1992 | Bobel et al. | 315/209 R |
| 5,175,474 | 12/1992 | Kakitani et al. | 315/209 R |

*Primary Examiner*—James B. Mullins
*Assistant Examiner*—J. Dudek
*Attorney, Agent, or Firm*—J. Ray Wood

[57] ABSTRACT

A circuit for driving gas discharge lamps has a bandpass filter coupled between the output of the inverter and the inverter control. The bandpass filter provides protection against the diode operation of the gas discharge lamps. The bandpass filter is composed of a capacitor and the permeance inductance of a transformer.

2 Claims, 1 Drawing Sheet

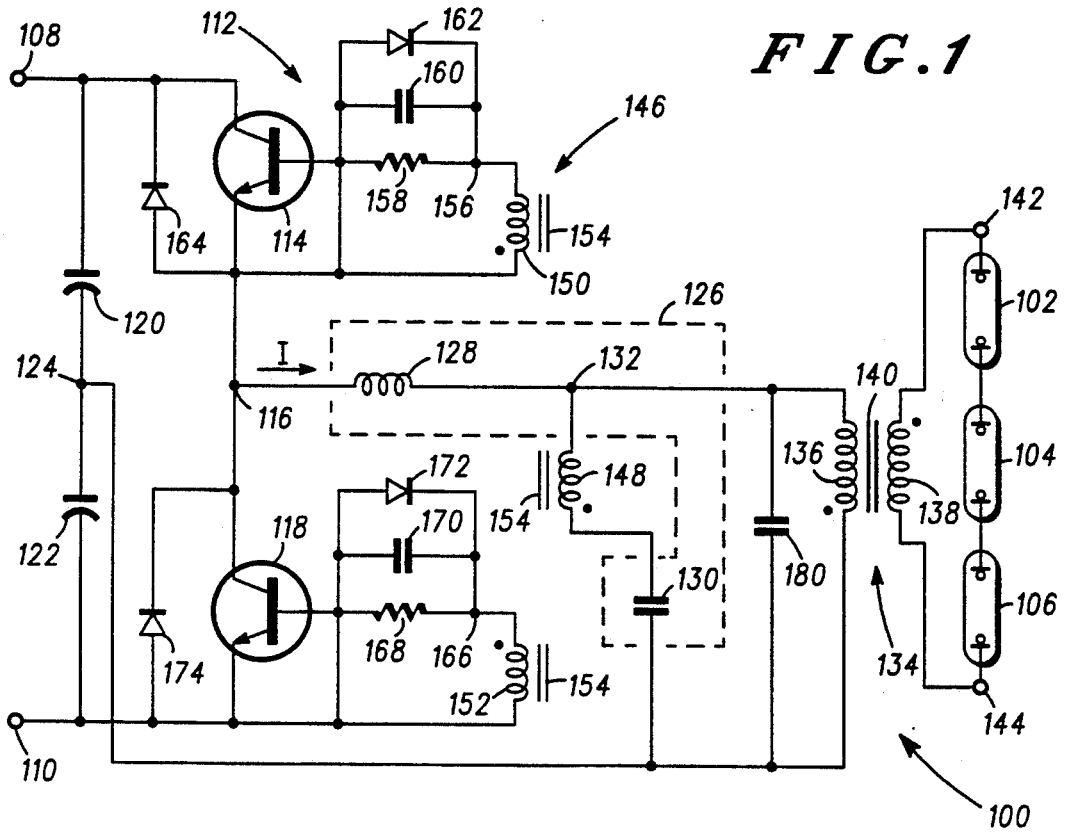
FIG. 1
FIG. 2
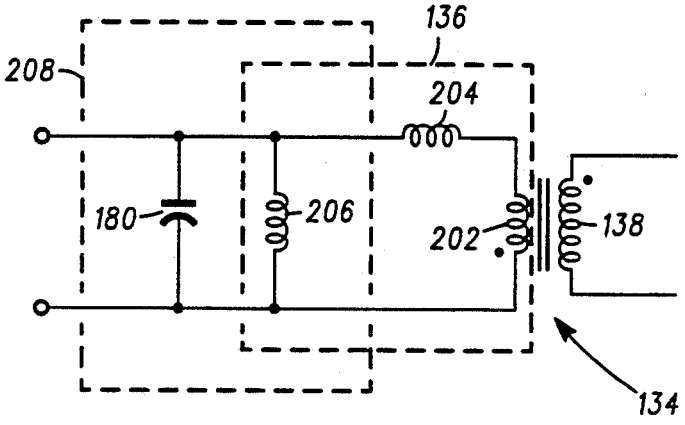

CIRCUIT FOR DRIVING GAS DISCHARGE LAMPS HAVING PROTECTION AGAINST DIODE OPERATION OF THE LAMPS

FIELD OF THE INVENTION

This invention relates to the driving of gas discharge lamp loads, and particularly, though not exclusively, to the driving of fluorescent lamps.

BACKGROUND OF THE INVENTION

In some electronic ballast circuits used to drive gas discharge lamps, a rectifier converts AC power to DC power. A two transistor inverter then converts the DC power to AC power at a very high frequency, usually on the order of 30 KHz. The AC power is coupled to the lamps, usually via a transformer. A feedback circuit uses the transformer to synchronize the opening and closing of the transistors. One such circuit for driving an array of gas discharge lamps is shown in U.S. Pat. No. 5,124,619.

Such an arrangement is efficient. However, the circuit is susceptible to "cross conduction". If both transistors are on at the same time, a direct short across the output of the rectifier results. This, in turn, results in component failure.

Lamp failure presents an opportunity for cross-conduction. When a gas discharge lamp begins to fail, it operates likes a diode. The result is that the current though the lamp has a "clipped" sinusoid waveform. The clipped sinusoid waveform effects the current in the transformer, thus impacting the feedback circuit that controls the inverter transistors. Absent a protection circuit, cross conduction results, and inverter components may fail.

SUMMARY OF THE INVENTION

A circuit for protecting the inverter from cross-conduction failure comprises an inverter, a feedback circuit and a bandpass filter coupled to the output of the inverter and the input of the feedback circuit.

A method for protecting the inverter circuit consists of filtering the inverter output and using the filtered output to control the inverter.

BRIEF DESCRIPTION OF THE DRAWINGS

FIG. 1 shows a schematic diagram for a gas discharge lamp drive circuit.

FIG. 2 shows a schematic diagram of a protection circuit for the gas discharge lamp circuit where the primary of the transformer is shown as an ideal transformer, a permeance inductor and a leakance inductor.

DESCRIPTION OF A PREFERRED EMBODIMENT

Referring now to FIG. 1, circuit 100 drives three gas discharge lamps 102, 104, 106. Input terminals 108, 110 receive a DC power supply voltage of approximately 390 V. Input terminals 108, 110 AC are the input to inverter 112.

Half bridge two transistor inverter 112 has bipolar NPN transistor 114 connected via the collector to positive input terminal 108. (While an NPN bipolar junction transistor is shown, a variety of other semiconductor devices could be used, such as PNP transistors or gate controlled switches.) The emitter of transistor 114 is connected to node 116. Transistor 118 is a bipolar NPN transistor The collector of transistor 118 is connected to node 116, the emitter is connected to the ground input terminal 110.

Capacitors 120, 122 are connected in series between input terminals 108, 110, and thus in parallel with transistors 114, 118, via node 124.

Series resonant tank circuit 126 has inductor 128 and capacitor 130 connected in series between node 116 and node 124 via node 132.

Load coupling transformer 134 has primary winding 136 and secondary winding 138 wound on core 140. Primary winding 136 of transformer 134 is connected between node 132 and node 124. Secondary winding 138 of transformer 134 is connected between output terminals 142, 144. Fluorescent lamps 102, 104, 106 are connected in series between output terminals 142, 144.

Inverter coupling transformer 146 has primary winding 148 and two secondary windings 150, 152 wound on core 154. Primary winding 148 of transformer 146 and capacitor 130 are connected in series between node 132 and node 124.

Transistor 114 is driven as a switch by way of a tank circuit coupled to transformer 146. Secondary winding 150 is connected between node 156 and the emitter of transistor 114. Transistor 114 has its base connected to node 156 via current-limiting resistor 158. Capacitor 160 is connected in parallel with resistor 158. Diode 162 has its anode connected to the emitter of transistor 114 and its cathode connected to node 156. Diode 164 has its anode connected to the emitter of transistor 114 and its cathode connected to the collector of transistor 114.

Transistor 118 is similarly controlled. Secondary winding 152 is connected between node 166 and the emitter of transistor 118. Transistor 118 has its base connected to node 166 via current-limiting resistor 168. Capacitor 170 is connected in parallel with resistor 168. Diode 172 has its anode connected to the base of transistor 116 and has its cathode connected to node 166. Diode 174 has its anode connected to the emitter of transistor 118 and its cathode connected to the collector of transistor 118.

During operation of circuit 100, transistors 114, 118 act as switches to chop the DC voltage supplied via terminals 108, 110 into a square wave. Capacitors 120, 122 supply charge during alternate half-cycles. An AC voltage is thus obtained between node 116 and node 124.

Transformer 154 via secondary 150 and secondary 152 synchronizes the switching of transistors 114, 118. The series-resonant tank circuit 126 formed by inductor 128 and capacitor 130 resonates approximately at its natural resonant frequency, substantially independent of variations in the load presented by lamps 102, 104, 106.

A feedback circuit is formed by inverter-coupling transformer 146 and capacitor 130. Transformer 146, the inverter control, causes oscillation of series-resonant tank circuit 126 to control the conduction of transistors 114, 118. When the current in the primary winding 148 of the transformer 146 is in a first direction, the voltage induced in secondary winding 150 and applied to the base of transistor 118 causes transistor 118 to conduct and to supply current in the first direction to tank circuit 126. Conversely, when the current in primary winding 148 of the transformer is in a second direction opposite the first direction, the voltage induced in the secondary winding 150 and applied to the base of transistor 114 causes transistor 114 to conduct and to supply current in the second direction to tank circuit 126.

Capacitor 180 is connected between node 132 and node 124, in parallel with transformer 134.

The interaction of capacitor 180 and transformer 134 is shown by reference to FIG. 2. Transformer 134 is shown as ideal transformer 202, leakage inductor 204, and permeance inductor 206. Capacitor 180 is used in unison with permeance inductor 206 to form bandpass filter 208 in the form of an LC (inductor-capacitor) parallel resonant circuit.

To form bandpass filter 208, the reactance of the parallel combination of capacitor 180 and permeance inductor 206 must be controlled. Selection of the capacitance of capacitor 180 is straightforward. However, altering the inductance of permeance inductor 206 is not straightforward. The physical construction of the transformer itself must be modified.

Modification of the inductance of the transformer is accomplished by manipulating the iron core of the transformer. Changing the spacing between the primary winding and secondary winding of the transformer alters the permeance inductance of the transformer.

By selection of an appropriate capacitance of capacitor 180 and modifying the permeance inductance of transformer 134, bandpass filter 136 is tuned for a particular operating frequency. Bandpass filter 136 is coupled to the output of inverter 112 and the inverter control, transformer 146.

When a gas discharge lamp starts to fail, it acts like a diode. The current through the lamp exhibits a "clipped" sinusoid waveform. Using Fourier analysis, the "clipped" waveform may be considered as a combination of a primary sinusoid waveform at the operating frequency of the lamp plus an infinite number of sinusoid waveforms at other frequencies. Thus, by filtering from that waveform all frequencies other than the operating frequency, a control signal is obtained to drive inverter 112.

The bandpass filter is tuned to allow only frequencies within the range of the desired operating frequencies of the lamps to pass into the feedback circuit formed by transformer 148 and capacitor 130. Thus, distortion in inverter current caused by the diode action of any lamp is reduced.

The specific embodiment of the invention which has been described is one example of an application of the principles of the present invention. Numerous modifications can be made by those skilled in the art without departing from the spirit and scope of the invention.

We claim:

1. A circuit for powering gas discharge lamps from a DC power source comprising:

a two transistor DC to AC inverter, the input of the inverter coupled to the DC power source;

a transformer having a primary winding and a secondary winding, the primary winding coupled to the output of the inverter, the secondary winding coupled to the gas discharge lamps;

the transformer further having a permeance inductance;

a control circuit having an input and an output, the control circuit for controlling the conductivity of the inverter transistors;

a bandpass filter having an input and an output, the input coupled to the output of the inverter, and the output coupled to the input of the control circuit;

the bandpass filter comprised of a capacitor and the permeance inductance of the transformer, the bandpass filter tuned to the operating frequency of the inverter.

2. A circuit for powering one or more gas discharge lamps with AC power at an operating frequency, from a source of DC power comprising:

an inverter having an input, an output and a control, the inverter input connected to the source of DC power;

a transformer having a permeance inductance, a primary winding and a secondary winding, the primary winding coupled to the output of the inverter and the secondary winding coupled to the gas discharge lamps;

a feedback circuit having an input and an output, the input of the feedback circuit coupled to the primary winding of the transformer, and the output of the feedback circuit coupled to the inverter control; and a bandpass filter having a capacitance and an inductance, the inductance supplied by the permeance inductance of the transformer, the bandpass filter coupled to the inverter output and the feedback circuit input, the bandpass filter tuned to the operating frequency.

* * * * *